US006402668B1

(12) United States Patent
Harker

(10) Patent No.: US 6,402,668 B1
(45) Date of Patent: Jun. 11, 2002

(54) SLOTTED EXERCISE APPARATUS

(76) Inventor: Shon Les Harker, 1425 S. 2469 West, Syracuse, UT (US) 84075

( * ) Notice: Subject to any disclaimer, the term of this patent is extended or adjusted under 35 U.S.C. 154(b) by 0 days.

(21) Appl. No.: 09/458,188

(22) Filed: Dec. 9, 1999

(51) Int. Cl.[7] ..... A63B 21/02
(52) U.S. Cl. ..... 482/121; 482/126
(58) Field of Search ..... 482/121, 122, 482/125, 126, 91, 106

(56) References Cited

U.S. PATENT DOCUMENTS

| | | | | | |
|---|---|---|---|---|---|
| 113,384 | A | * | 4/1871 | Barnett | |
| 4,195,835 | A | | 4/1980 | Hinds et al. | 272/137 |
| 4,326,708 | A | | 4/1982 | Hinds | 272/138 |
| 4,779,867 | A | | 10/1988 | Hinds | 272/137 |
| 4,836,537 | A | * | 6/1989 | Moreno | 272/143 |
| 5,052,681 | A | * | 10/1991 | Williams | 272/136 |
| 5,549,532 | A | * | 8/1996 | Kropp | 482/126 |
| 5,571,064 | A | * | 11/1996 | Holm | 482/129 |
| 5,720,700 | A | * | 2/1998 | Buoni et al. | 482/124 |
| 5,746,687 | A | * | 5/1998 | Vial et al. | 482/126 |
| 5,776,041 | A | | 7/1998 | Fisher | 482/125 |
| 5,800,322 | A | | 9/1998 | Block | 482/126 |
| 5,885,196 | A | * | 3/1999 | Gvoich | 482/125 |

FOREIGN PATENT DOCUMENTS

| | | | | |
|---|---|---|---|---|
| DE | 3306320 A1 | * | 3/1984 | 482/121 |
| FR | 0538316 | * | 6/1922 | |

* cited by examiner

*Primary Examiner*—Denise M. Pothier
(74) *Attorney, Agent, or Firm*—Madson & Metcalf

(57) ABSTRACT

The present invention provides a rigid bar configured with an interior cavity and apertures on the ends of the bar. The bar is further configured with two slots with each slot in communication with a corresponding aperture and the cavity. The invention further includes handles which are attached to the ends of the elastic member. Each handle may be configured generally in a stirrup configuration and has an engaging portion which is insertable into an aperture and the cavity of the bar. The handle further has an extending portion which, as the engaging portion is inserted into the cavity, is feed into the corresponding slot. The extending portion extends from the cavity and through the slot and attaches to an end of the elastic member. The bar may further be disassembled into two or more portions to facilitate compact storage.

20 Claims, 8 Drawing Sheets

SLOTTED EXERCISE APPARATUS

BACKGROUND

1. The Field of the Invention

The present invention relates to exercise equipment incorporating elastics for use in a variety of physical exercise applications.

2. The Background Art

Stretchable members have numerous applications for use in fastening, bundling, and otherwise generally containing objects. The stretch ability of such members makes them ideal for such purposes. Stretchable members also have application in exercising. The durability and stretch resistance of certain stretchable members makes them ideal for repetitive movements required in exercising. The stretchable members are often embodied as tubular elastics formed of latex. The elastics do not take as much space as free weights or other exercise equipment thus making them ideal for travel, storage, or exercising in limited space.

In practice, one end of the elastic may be connected or affixed to a stationary location and the user may repeatedly pull the other end of the elastic away from the stationary location to exercise selected muscles. The types of exercises that may be performed with the elastic in this manner vary as do the methods for attaching the elastic to a stationary location and the user.

The elastic may further be used with a rigid bar to form an exercise device as is disclosed in U.S. Pat. Nos. 4,195,835, 4,326,708, 4,779,867, and 5,776,041. In this application, the elastic is connected to the rigid bar, such as at the midsection of the elastic, and the ends of the elastic are then connected to stirrups. A user then inserts the user's feet into the stirrups and grips the rigid bar with both hands and repeatedly raises the bar to the chest or head level. In this manner, the user exercises through repeated use of the stretch resistance. Other exercises are also possible by engaging the feet and hands with the stirrups and the rigid bar respectively.

A common concern in the use of elastic exercise equipment is that the elastic may break or disengage from its anchor when it is under tension. This may result in injury to the user. In the above described elastic and bar device, it is necessary that the elastic remain secured to the rigid bar. One purpose of the device, however, is the ability to quickly assemble and disassemble the device for travel and storage. Thus, the elastic is not permanently anchored to the rigid bar and presents a risk of the elastic disengaging the bar. Furthermore, both the user's feet must maintain contact with the stirrups during exercise. If one of the user's feet slips from a stirrup when the elastic is under tension, the stirrup may impact the user and cause injury.

A further concern in the exercise equipment industry is the ability to economically manufacture a reliable, safe, and effective product. Profit margins are such that even slight reductions in manufacturing costs may be the difference between commercial viability and a failed product.

Thus, it would be an advancement in the art to provide an elastic exercise bar which provides improved anchoring of the components to reduce risk of injury. It would be a further advancement in the art to provide an elastic exercise bar which is more economical to manufacture. These advantages of the present invention will become more fully apparent by examination of the following description of the preferred embodiments and the accompanying drawings.

BRIEF SUMMARY OF THE INVENTION

The present invention provides an improved elastic exercise apparatus having a rigid bar configured with an interior cavity and apertures on the ends of the bar. The bar may be cylindrical in shape and is configured with two slots with each slot adjacent the ends of the bar. The slots are in communication with the apertures and the cavity. The apparatus further comprises an elastic member and handles attached to the ends of the elastic member. Each handle may be configured generally in a stirrup configuration and has an engaging member which is insertable into an aperture and the cavity of the bar. The handle further comprises an extending member which, as the engaging member is inserted into the cavity, is fed into the corresponding slot. The extending member, therefore, extends from the cavity and through the slot. The ends of the elastic member are attached to portions of the extending member which are exterior to the bar cavity. The bar may further be disassembled into two or more sub-members to facilitate compact storage of the apparatus.

In operation, a user assembles the apparatus by engaging portions of the bar to complete assembly of the bar. The user then inserts the handles into the cavity of the bar to anchor the elastic member to the bar. The user then places both feet on the approximate midsection of the elastic member and grips the bar in both hands. The user exercises by lifting the bar repeatedly to the chest or head level.

Thus, it is an object of the present invention to provide an elastic exercise apparatus suitable for repetitive exercises which provides superior anchoring of the elastic member to reduce risk of injury and which is economic to manufacture.

Such a device is disclosed and claimed herein.

BRIEF DESCRIPTION OF THE DRAWINGS

In order that the manner in which the above-recited and other advantages and features of the invention are obtained, a more particular description of the invention summarized above will be rendered by reference to the appended drawings. Understanding that these drawings only provide selected embodiments of the invention and are, therefore, not to be considered limiting of its scope, the invention will be described with additional specificity and detail through use of the accompanying drawings in which.

DETAILED DESCRIPTION OF THE PREFERRED EMBODIMENTS

The presently preferred embodiments of the present invention will be best understood by reference to FIGS. 1 to 6 wherein like parts are designated by like numerals throughout. It will be readily understood that the components of the present invention, as generally described and illustrated in the figures herein, could be arranged and designed in a wide variety of different configurations. Thus, the following more detailed description of the embodiments of the apparatus, system, and method of the present invention, as represented in FIGS. 1 through 6, is not intended to limit the scope of the invention, as claimed, but is merely representative of presently preferred embodiments of the invention.

Figure 1:
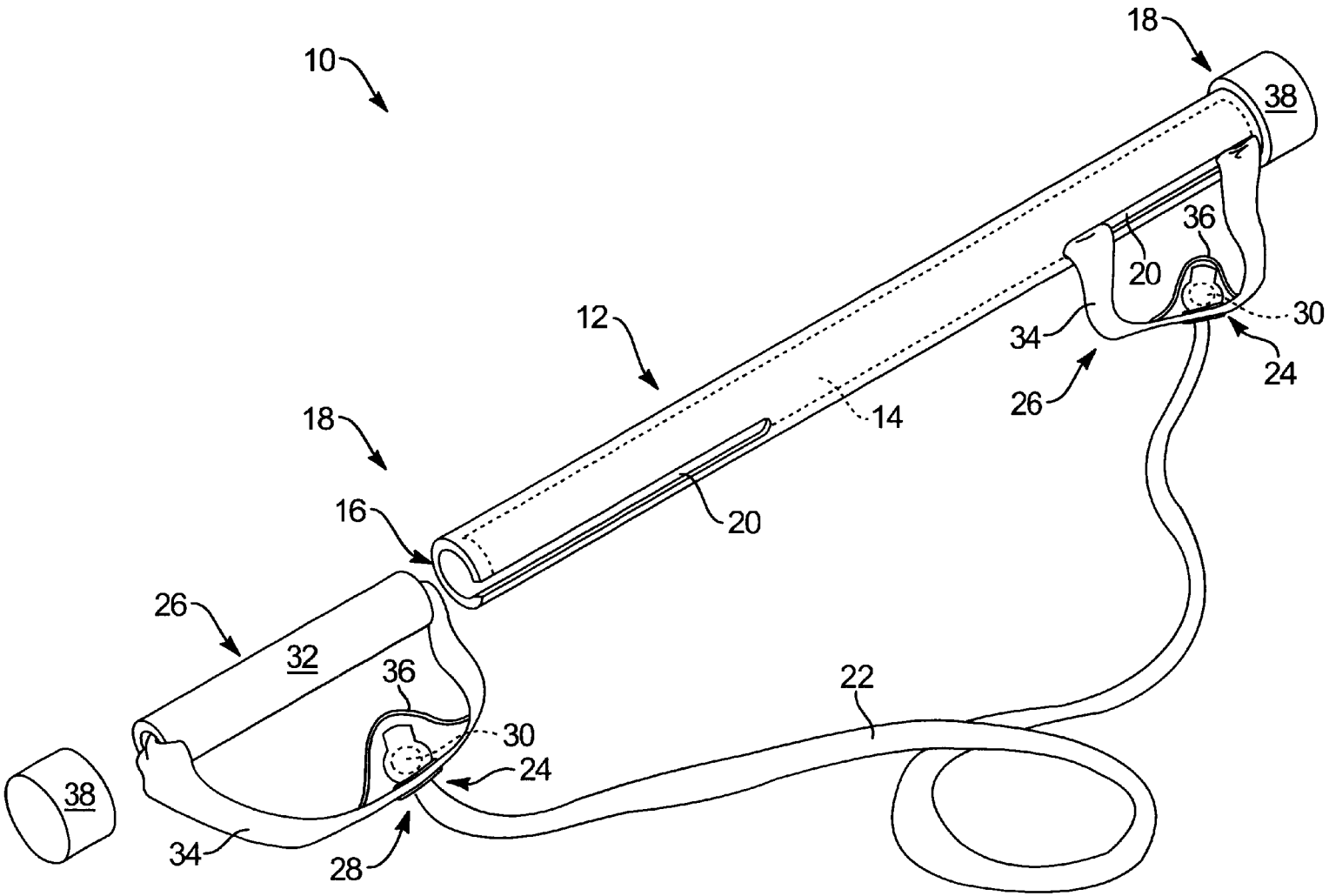
FIG. 1 is a perspective view of one embodiment of the elastic exercise apparatus of the present invention.

In one presently preferred embodiment shown in FIG. 1, the elastic exercise apparatus of the present invention is shown and generally designated 10. The apparatus 10 comprises a bar 12 having a certain longitudinal length and two opposing ends. The bar 12 may be formed of a variety of materials such as metal or plastic. Plastic is a presently preferred material as it is lightweight and relatively inexpensive to manufacture. The bar 12 may be configured in a cylindrical shape as shown or may be embodied in alternative shapes such as a rectangular shape. The bar 12 may further be configured with curves and bends along its longitudinal length as desired to facilitate gripping of the bar 12 to thereby achieve an ergonomic design. The bar 12 has a diameter or outer dimension that allows it to be comfortably gripped by the user.

The bar 12 has an interior cavity 14 (shown in phantom) which, in one embodiment, extends along the longitudinal length of the bar 12. The bar 12 is further configured with apertures 16 disposed on opposing ends 18 of the bar 12. The apertures 16 communicate with the cavity 14. The cavity 14 is defined herein as extending along the entire longitudinal length of the bar 12 or, alternatively, may comprise one or more voids within the interior of the bar 12. It is sufficient that the cavity 14 communicate with an aperture 16 for purposes of the invention.

The bar 12 further comprises a slot 20 which extends from an aperture 16 to a certain longitudinal length along the bar 12 and runs parallel to the longitudinal axis of the bar 12. The slot 20 communicates with the aperture 16 and the cavity 14. The length of the slot 20 may be slightly larger than the typical width of a user's hand. In one embodiment the slot may have a width of ¼ of an inch and a length of 6 inches. Preferably the bar 12 comprises two slots 20 with each slot 20 disposed adjacent to each end 18 and communicating with their respective apertures 16 and the cavity 14.

The elastic exercise apparatus 10 further comprises a flexible, stretchable elastic member 22. The elastic member 22 is configured to have a certain longitudinal length and first and second ends 24. In one embodiment, the elastic member 22 is configured in a tubular shape having an inner cavity which traverses the longitudinal length of the elastic member 22. The elastic member 22 is formed of an elastic material which is defined herein as a material which is capable of returning to an original length or shape after being stretched. In one embodiment, the elastic material comprises latex. In such an embodiment, the elastic member 22 may have a stretch of up to seven times its original length. Latex materials have great elongation abilities with a material memory that allows it to return to nearly its original length even after repetitive use. Such capability is advantageous for exercise equipment.

In alternative embodiments, the elastic material may comprise non-latex materials including natural rubber. Such alternative materials may be adequate for use in the present invention, provided that they are capable of stretch and retraction. However, generally such materials do not provide for the superior stretch afforded by latex based materials.

The apparatus 10 further comprises handles 26 which are connected to the opposing ends 24 of the elastic member 22. The handles 26 may be connected to the elastic member 22 in a various ways including connectors, such as rings, clips, clamps, crimps, and fasteners. Alternatively, the handle 26 may have a connecting aperture 28 through which a portion of the elastic member 22 passes. The elastic member 22 is then tied into a knot having a cross-section larger than the aperture 28 to prevent pull back. In an alternative method, a rigid collar is fastened to an end 24 of the elastic member 22 after the end 24 has passed through the aperture 28. The collar has an outer diameter greater than that of the aperture 28 to prevent pull back. One of skill in the art will appreciate that other methods of connecting the handles 26 to the elastic member 22 are possible and are well known in the art and include the use of wrapping, tying, sewing, or using adhesives.

In the embodiment shown in FIG. 1, the handle 26 is attached to the elastic member 22 by use of a rigid spherical-shaped object 30 (shown in phantom), such as a ball. In this embodiment, the elastic member 22 is in a tubular configuration. One end 24 of the elastic member 22 passes through the connecting aperture 28. The object 30 is then inserted into a cavity at the end 24 of the elastic member 22. The object's 30 diameter is greater than the diameter of the inner cavity of the elastic member 22. Thus, the elastic member 22 has a greater diameter at the location of the object 30 than the aperture 28 and can no longer pass through the aperture 28 in one direction.

The apparatus 10 shown in FIG. 1 illustrates one handle 26 inserted into the cavity 14 and ready for use and another handle 26 removed from the cavity 14. The handle 26 may be configured in a general stirrup shape and comprises an engaging member 32 for insertion into the cavity 14 of the bar 12. The handle 26 further comprises an extending member 34 which may be in a U-shape and is configured to protrude from the slot 20 when the engagement member 26 is inserted into the cavity 14.

In the embodiment shown in FIG. 1, the handle 26 comprises a loop of flexible fabric material which forms the engaging member 32. The engaging member 32 is preferably rigid and, having a shape and diameter which facilitates insertion into the cavity 14. The fabric material may pass through the interior of the engaging member 32 or may be attached to the engaging member 32. During assembly of the apparatus 10, the engaging member 32 is inserted into the aperture 16 and the cavity 14. As the engaging member 32 slides into the cavity 14, the slot 20 receives the extending member 34 to thereby allow the extending member 34 to pass out of the cavity 14. The elastic member 22 connects to the extending member 34 such as by use of the aperture 28 as previously discussed. Disassembly of the apparatus 10 is readily achieved by removing the engaging member 32 from the cavity 14.

In the embodiment of FIG. 1, the handle 26 may further comprise a retention strap 36 looping over the aperture 28 and connected to the extending member 34 at both ends. The retention strap 36 limits movement of the elastic member 22 through the aperture 28. In this manner, the retention strap 36 and the object 30 retain the general position of the elastic member 22 relative to the handle 26.

With the engaging member 32 inserted into the cavity 14, a cap 38 may be inserted over the end 18 of the exercise bar 12. The cap 38 should be sufficiently tight fitting to retain the engagement member 26 within the cavity 14 during normal use.

Figure 2:
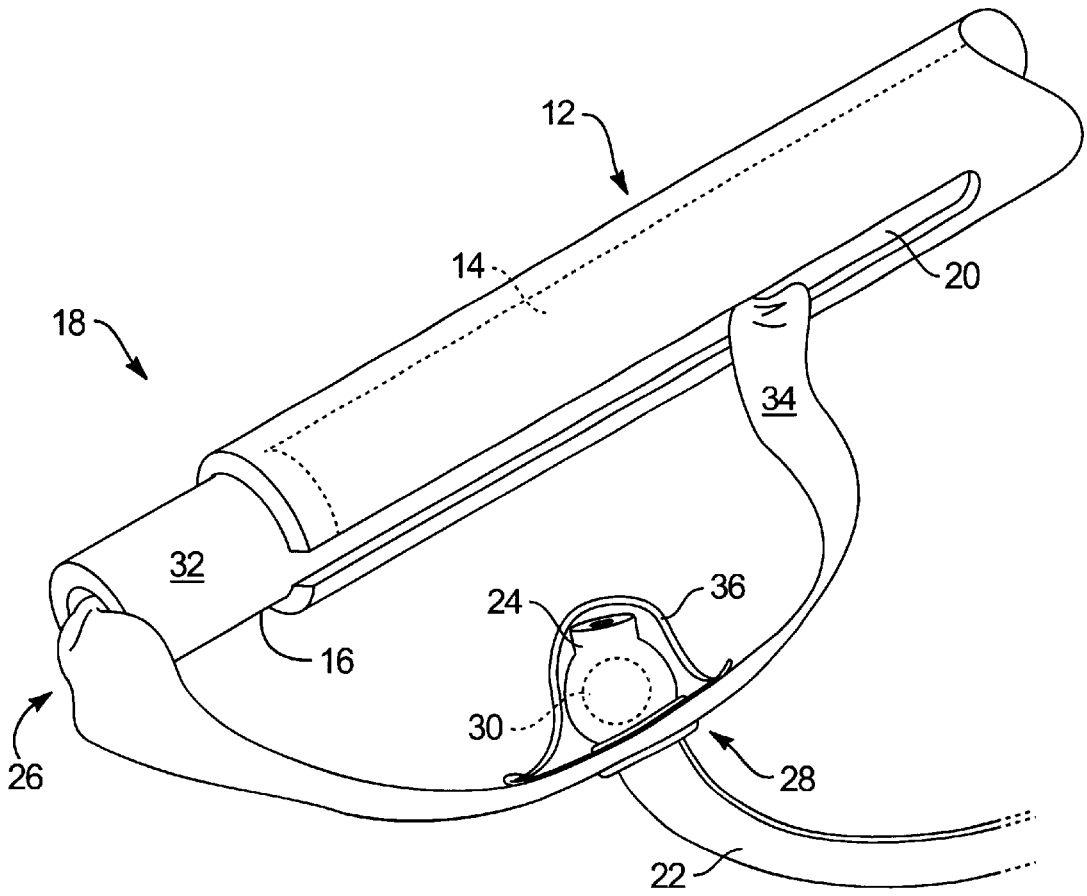
FIG. 2 is a perspective view of one end of the elastic exercise apparatus of the embodiment of FIG. 1.

Referring to FIG. 2, an enlarged view of the handle 26 is shown as the engaging member 32 passes into the aperture 16 and into the cavity 14. The extending member 34 passes through the slot 20 as the engaging member 32 passes into the cavity. The insertion of the engaging members 32 into the cavity 14 anchors the handles 26 to prevent disengagement of the handles 26 during exercise. There may be friction between the engaging member 32 and the bar 12 to prevent loose movement of the engaging member 32 relative to the bar 12.

Figure 3:
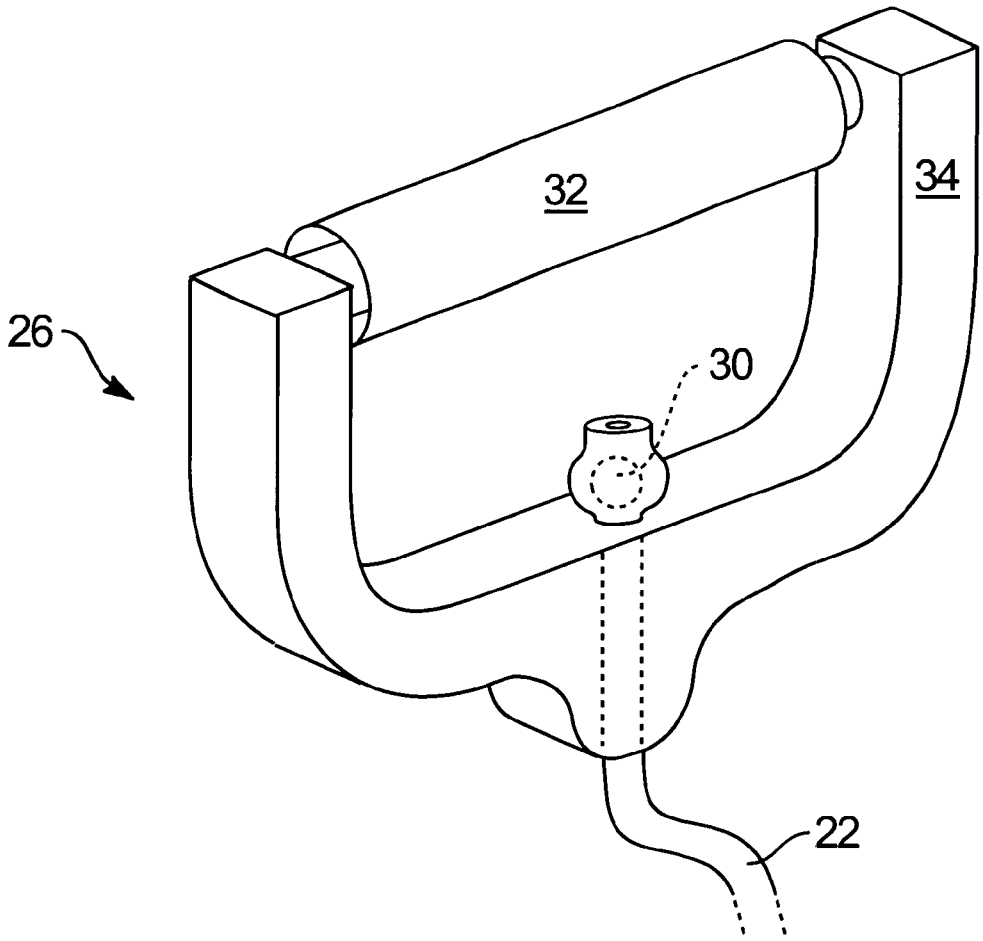
FIG. 3 is a perspective view of an alternative embodiment of a handle of the elastic exercise apparatus of the present invention.

Referring to FIG. 3, an alternative embodiment of the handle 26 is shown. The engaging member 32 and the extending member 34 are formed of a rigid material, such as plastic. The handle 26 is thus fixed in a stirrup shape. In such an embodiment, the extending member 34 may also be configured with an aperture 28 for connection of the elastic member 22 as previously discussed.

After both handles 26 are inserted into the cavity 14, the apparatus 10 may be used for physical exercise. One popular method for exercise is for a user to position the midsection of the elastic member 22 under one or both feet to retain the elastic member 22 in position. By positioning the elastic member 22 under both feet there is reduced chance of injury. If the elastic member 22 slips from one foot, the securement of the elastic member 22 to the other foot will prevent injury to the user. With conventional equipment utilizing foot stirrups, one foot slipping while the elastic member 22 is under tension will release a foot stirrup. Thus, the present invention provides added safety by allowing both feet to contact the midsection of the elastic member 22. In one exercise application, with the feet securing the midsection of the elastic member 22, the user grips the bar 12 and pulls the bar up to the user's chest level or head level. This may be done with the bar 12 in front or in back of the user.

In another exercise application, the midsection of the elastic member 22 is anchored or otherwise secured to a surface such as a wall, ceiling or door. The user grips the bar 12 and pulls away from the surface towards the user's front or back. In yet another exercise application, the user may do bench presses, by placing the elastic member 22 behind the back and the bar 12 in front of the chest and pressing the bar 12 away from the user's chest. A useful feature is that the bar 12 may be rolled to entwine a portion of the elastic member 22 onto the bar 12. This shortens the length of the elastic member 22 that is used in exercise which in turn increases the resistance of elastic member 22. One of skill in the art will appreciate that other exercise activities are possible with the present invention.

Figure 4:
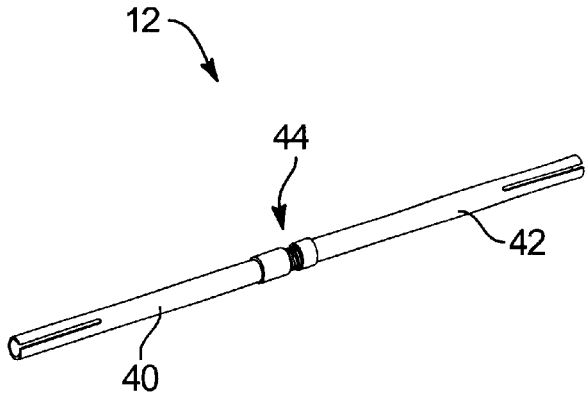
FIG. 4 is a perspective view of one embodiment of the slotted bar of the present invention.

Referring to FIG. 4, an additional feature of the bar 12 of the apparatus 10 is shown. The bar 12 may be divided approximately in the center into first and second members 40, 42 to facilitate compact storage of the bar 12. In such an embodiment, the bar 12 further comprises a locking mechanism 44 for engaging the first and second members 40, 42. The locking mechanism 44 must be sufficiently robust to withstand repeated assembly and disassembly of the bar 12. Furthermore, the locking mechanism 44 must withstand repeated use of the apparatus 10 during exercise.

Division of the bar 12 further allows for an additional exercise application. With the first and second members 40, 42 separated, the user may grip either member 40, 42 and anchor the elastic member 22 to the user's feet or other location. A user may then pull the member 40, 42 from the anchoring location. A user may further grip both members 40, 42 with one in each hand and pull the members 40, 42 from an anchoring location for an exercise similar to that performed with conventional dumbbells.

Figure 5:
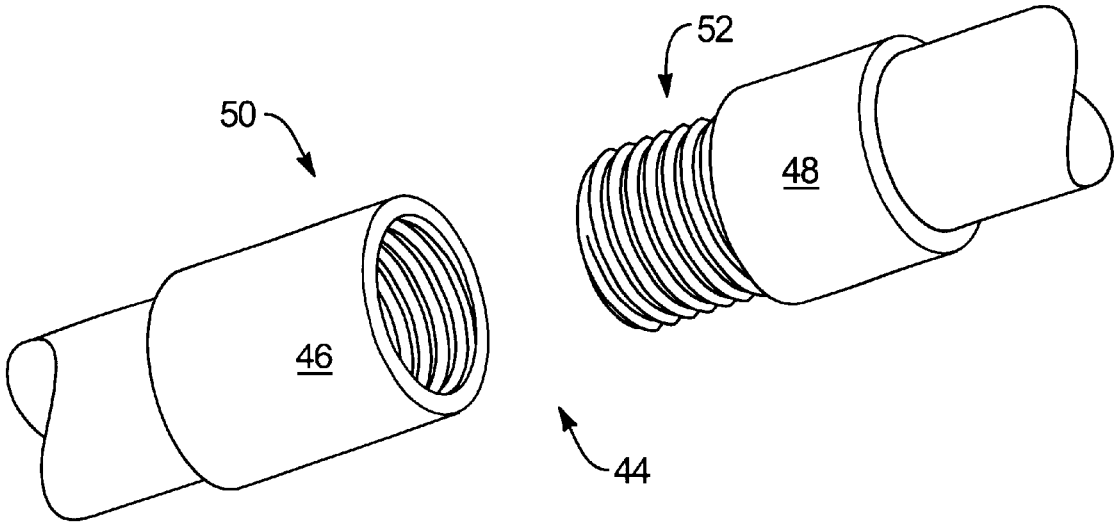
FIG. 5 is a perspective view of one embodiment of the locking mechanism of the present invention.

Referring to FIG. 5, an enlarged view of one embodiment of the locking mechanism 44 is shown. The locking mechanism 44 comprises inner and outer threads 46, 48 disposed on the interior ends 50, 52 of the first and second members 40, 42. The threads 46, 48 are engaged by screwing the ends 50, 52 of the first and second members 40, 42 together. In this manner, the first and second members 40, 42 are secured to one another through a threadable engagement.

Figure 6:
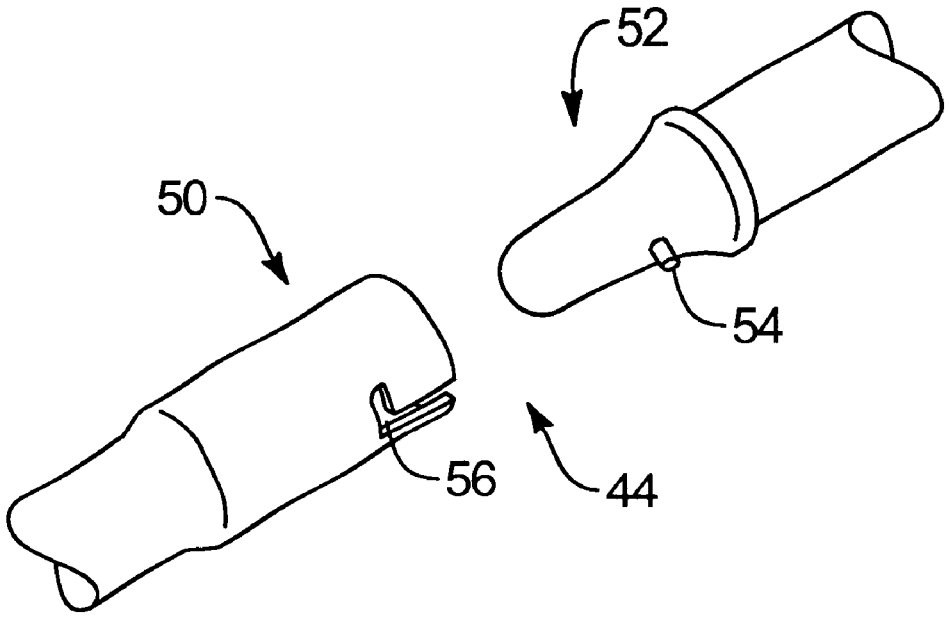
FIG. 6 is a perspective view an alternative embodiment of the locking mechanism of the present invention.

Referring to FIG. 6, an alternative embodiment for the locking mechanism 44 is shown. In this embodiment, a pin 54 is disposed on an end 52 of the second member 42. The end 50 is configured with an inner diameter sufficient to receive a portion of the end 52. The end 50 is further configured with a slot 56, such as an L-shaped slot, to receive the pin 54. In assembly, the pin 54 is introduced into the slot 56 and the first and second members 40, 42 are twisted to nest the pin 54 within the slot 56.

Figure 7:
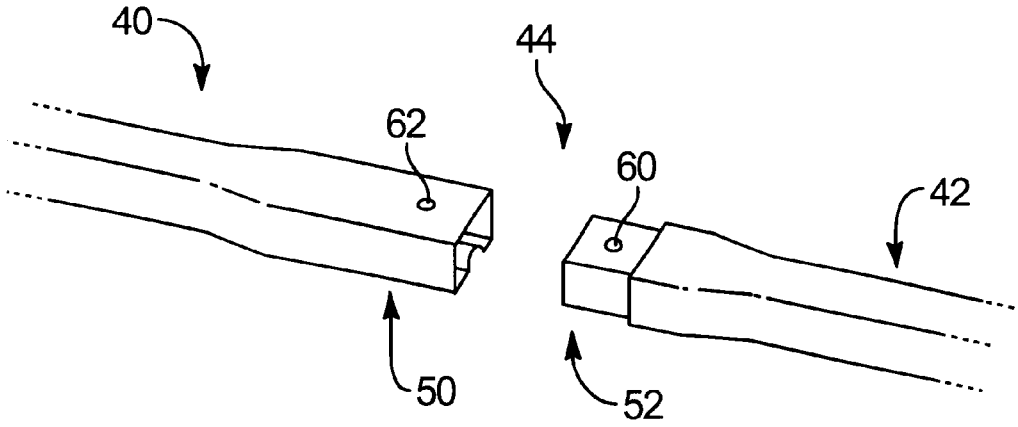
FIG. 7 is a perspective view of an alternative embodiment of the locking mechanism of the present invention.

Referring to FIG. 7, an alternative embodiment for the locking mechanism 44 is shown. In this embodiment, a pin 60 biased in an extended position is disposed on an end 52 of the second member 42. The pin 60 may be biased in various ways such as by use of a spring as is well known in the art. The end 50 is configured with an inner dimension sufficient to receive a portion of the end 52. The end 50 is further configured with a locking aperture 62 to receive the pin 60. In assembly, the pin 60 is depressed and the end 52 is inserted into the end 50. The pin 60 then extends into the extended position to lock into the aperture 62 to thereby retain the engagement of the first and second members 40, 42.

In one embodiment, the apparatus 10 may further comprise a protective pad which is disposed proximate to the center of the bar 12. The pad may be configured in two portions with each portion disposed around the ends 50, 52 of the first and second members 40, 42. The pad serves to protect the locking mechanism 44 and to protect a user from abrupt contact with the bar 12 during exercise.

Figure 8:
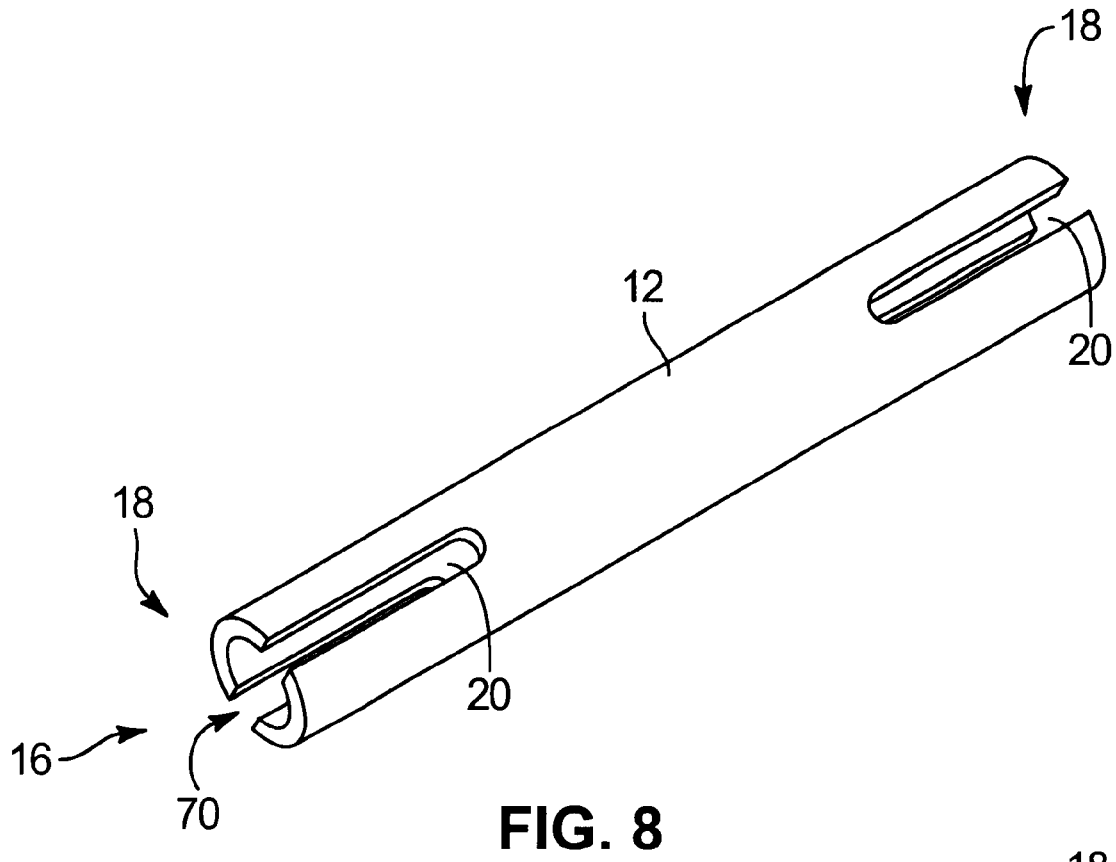
FIG. 8 is a perspective view of an alternative embodiment of the slotted bar of the present invention.

Referring to FIG. 8, an alternative embodiment for the bar 12 is shown. In this embodiment, the bar 20 is generally configured as that of FIG. 1 with additional opposing slots 70 on both ends 18 of the bar 12. The opposing slots 70 are preferably disposed parallel to and in line with the slot 20. The opposing slots 70 are in communication with the aperture 16 and the interior cavity 14 of the bar. The opposing slots 70 serve to further engage the handle 26 as described below.

Figure 9:
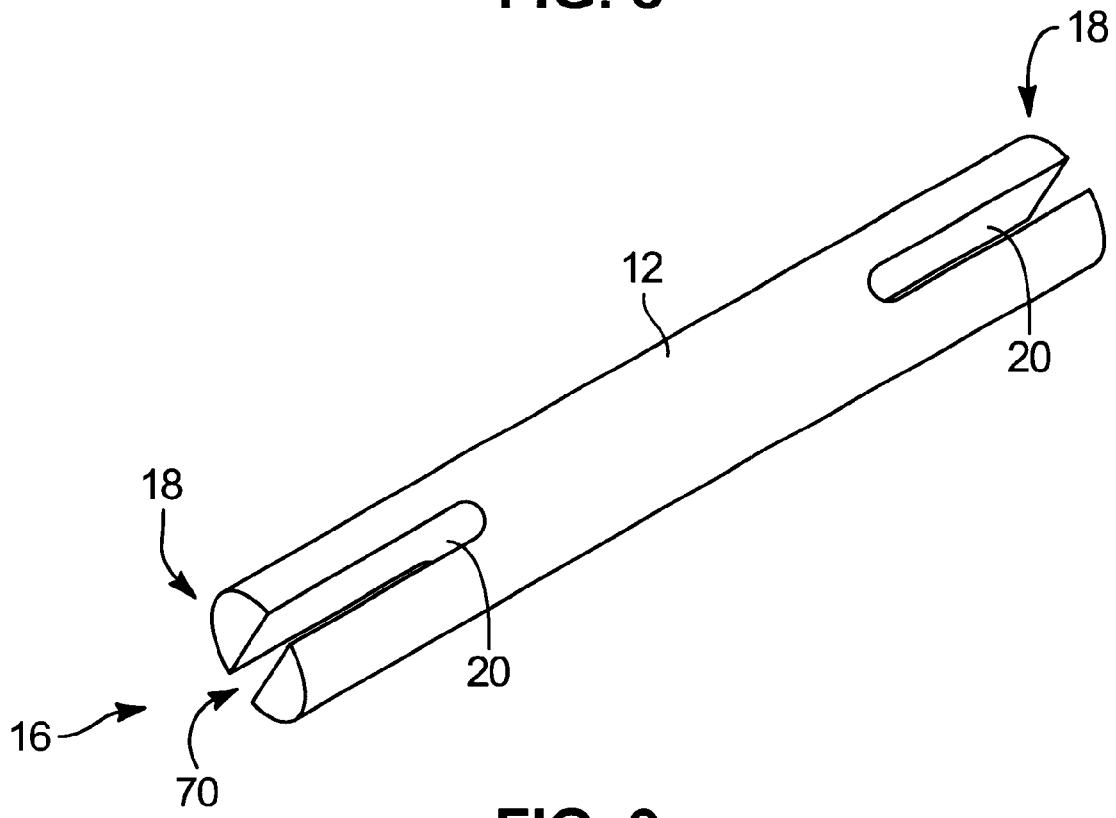
FIG. 9 is a perspective view of another alternative embodiment of the slotted bar of the present invention.

Referring to FIG. 9, another alternative embodiment for the bar 12 is shown. This embodiment is similar to that of FIG. 8 in that the bar 12 is configured with opposing slots 70 on each end 18. As before, the opposing slots 70 are parallel to and in line with the slots 20. The bar 12 differs from that of FIG. 8 in that it is not configured with a cavity 14. Instead, the bar 12 may be solid except for the areas defined by the slots 20 and opposing slots 70 which are in communication with one another. As can be appreciated, the embodiments of the bar 12 shown in FIGS. 8 and 9 may be configured to separate into first and second members 40, 42 as shown in FIGS. 4–7. The embodiments of the bar 12 shown in FIGS. 8 and 9 may further be contoured into various ergonomic designs.

Figure 10:
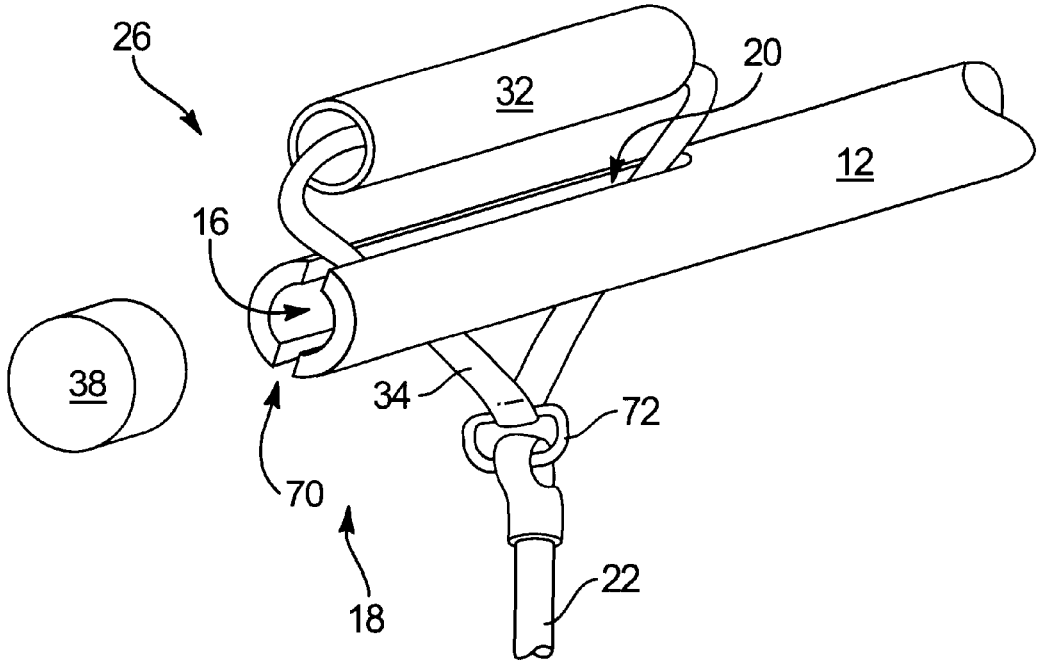
FIG. 10 is a perspective view of one end of the elastic exercise apparatus of the embodiment of FIG. 8.

Referring to FIG. 10, an enlarged view of the handle 26 is shown engaging an end 18 of the bar 12. The bar 12 is that of the embodiment shown in FIG. 8, but may also be that of the embodiment of FIG. 9. In this application, the engaging member 32 remains exterior to the bar 12 while the extending member 34 passes through both the slot 20 and the opposing slot 70. The slots 20,70 are configured with a dimension less than the diameter of the engaging member 32 such that the engaging member 32 is unable to pass through the slots 20, 70. In this manner, the engaging member 32 serves as an anchor to prevent passage of the handle 26 through the slots 20, 70 in one direction.

The slot 20 and opposing slot 70 must remain in communication with one another and preferably be in line with one another. The insertion of the extending member 24 into the slot 20 and opposing slot 70 anchors the handle 26 to prevent disengagement of the handle 26 during exercise. A cap 38 may be applied to an end 18 of the bar 12 to prevent disengagement of the handle 26 during exercise.

The handle 26 of FIG. 10 is secured to the elastic member 22 in an alternative manner than that previously shown and is referred to as a "tuck in" attachment. In this embodiment, the extending member 34 is secured to a ring 72 by securing the extending member 34 together by sewing or adhesives. An aperture is formed in the elastic member 22 proximate to an end of the elastic member 22. The elastic member 22 passes through the ring 72 and is then threaded into the aperture to thereby form a lasso around the ring 72.

The apparatus 10 provides a novel elastic exercise device which allows for compact storage and easy assembly and disassembly. The apparatus 10 is quickly assembled by inserting the handles 26 into cavity 14 and slots 20 of the bar 12 and engaging the first and second members 40, 42. Disassembly is performed by reversing these steps. The apparatus 10 is durable for repetitive use and to endure the rigors of travel. The apparatus 10 provides added safety by providing improved anchoring of the elastic member 22 to the bar 12. If one foot loses contact with the elastic member 22 during exercise, the user is not likely to be injured. The apparatus 10 may further be manufactured economically.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive of the scope of the invention.

What is claimed and desired to be secured by United States Letters Patent is:

1. An exercise apparatus, comprising:

a bar member having a first open end, a second end, a slot, and a cavity, wherein the first open end is in communication with the cavity and the slot is disposed adjacent the end and extends along a surface of the bar member from the first open end of the bar member to a length intermediate the first open end and the second end and is in communication with the cavity;

an elastic member; and a handle attached to an end of the elastic member and having, an engaging portion inserted into the first open end and the cavity, and an extending portion connected to the engaging portion and to the elastic member, the slot simultaneously receiving the extending portion as the first open end and cavity receive the engaging portion, and the extending portion extending through and from the slot forming a gap between the bar member and a section of the extending portion for gripping the bar member.

2. The exercise apparatus of claim 1 wherein the second end comprises a second open end, wherein the bar member further comprises a second slot, wherein the second open end is in communication with the cavity and the second slot is disposed adjacent the second open end and extends along a surface of the bar member from the second open end of the bar member to a length intermediate the second open end and the first open end and is in communication with the cavity, and further comprising, a second handle attached to a second end of the elastic member and having, an engaging portion inserted into the second open end and cavity, and an extending portion connected to the engaging portion and to the elastic member, the slot simultaneously receiving the extending portion as the second open end and cavity receive the engaging portion, and the extending portion extending through and from the second slot forming a gap between the bar member and a section of the extending portion for gripping the bar member.

3. The apparatus of claim 1 wherein the bar member is configured in a cylindrical shape.

4. The apparatus of claim 1 further comprising a cap configured to receive and cover the first open end of the bar member to thereby facilitate retention of the engaging portion within the cavity.

5. The apparatus of claim 1 wherein the engaging portion comprises a rigid cylindrical bar.

6. The apparatus of claim 1 wherein the extending portion comprises a flexible fabric.

7. The apparatus of claim 1 wherein the handle comprises a rigid stirrup shaped member.

8. The apparatus of claim 1 wherein the bar member comprises first and second members and a locking mechanism for engaging and disengaging the first and second members.

9. The apparatus of claim 8 wherein the locking mechanism comprises threadable configurations disposed on ends of the first and second members to thereby allow threadable engagement of the first and second members.

10. The apparatus of claim 8 wherein the locking mechanism comprises a pin disposed adjacent an end of the first member and a slot disposed adjacent an end of the second member, wherein the slot is configured to receive and retain the pin.

11. The apparatus of claim 8 wherein the locking mechanism comprises a biased pin disposed on an end of the first member and an aperture disposed on an end of the second member, wherein the aperture is configured to receive and retain the pin.

12. The apparatus of claim 1 further comprising a rigid object disposed within an internal cavity of the elastic member, wherein the rigid object has a diameter greater than the diameter of the internal cavity, the extending portion configured with a connecting aperture for receiving a portion of the elastic member, wherein the diameter of the elastic member at the location of the rigid object is greater than the connecting aperture to thereby prevent passage of the rigid object through the connecting aperture.

13. A method for producing a slotted exercise bar, comprising:

providing a bar member having a first open end, a second end, a slot, and a cavity such that the first open end is in communication with the cavity and the slot is disposed adjacent the end and extends along a surface of the bar member from the first open end of the bar member to a length intermediate the first open end and the second end and is in communication with the cavity;

providing handle with an engaging portion and an extending portion, wherein the engaging portion is inserted into the first open end and the cavity, and the extending portion is connected to the engaging portion, and wherein the slot simultaneously receives the extending portion as the first open end and cavity receive the engaging portion, and the extending portion extends through and from the slot forming a gap between the bar member and a section of the extending portion for gripping the bar member; and attaching an elastic member to the extending portion of the handle.

14. The method of claim 13, wherein the second end comprises a second open end, and further comprising, providing the bar member with a second slot, wherein the second open end is in communication with the cavity and the second slot is disposed adjacent the second open end and extends along a surface of the bar member from the second open end of the bar member to a length intermediate the second open end and the first open end and is in communication with the cavity;

providing a second handle with an engaging portion and an extending portion, wherein the slot simultaneously receives the extending portion as the second open end and cavity receive the engaging portion, and wherein the extending portion extends through and from the second slot forming a gap between the bar member and a section of the extending portion for gripping the bar member;

and connecting the elastic member to the extending portion of the second handle.

15. The method of claim 13 comprising configuring the bar member in a cylindrical shape.

16. The method of claim 13 further comprising providing a cap to receive and cover the second open end of the bar member to thereby facilitate retention of the engaging portion within the cavity.

17. The method of claim 13 wherein the engaging portion comprises a rigid cylindrical bar.

18. The method of claim 13 wherein the extending portion comprises a flexible fabric.

19. The,method of claim 13 further comprising, providing the bar member with first and second members; and providing the bar member with a locking mechanism for engaging and disengaging the first and second members.

20. The method of claim 19 wherein the locking mechanism comprises threadable configurations disposed on ends of the first and second members to thereby allow threadable engagement of the first and second members.

* * * * *